United States Patent [19]

Shaw

[11] 4,439,121

[45] Mar. 27, 1984

[54] SELF-CLEANING SINGLE LOOP MIST TYPE LUBRICATION SYSTEM FOR SCREW COMPRESSORS

[75] Inventor: David N. Shaw, Unionville, Conn.

[73] Assignee: Dunham-Bush, Inc., West Hartford, Conn.

[21] Appl. No.: 354,008

[22] Filed: Mar. 2, 1982

[51] Int. Cl.[3] ..... F04C 18/16; F04C 29/02

[52] U.S. Cl. ..... 418/98; 418/201

[58] Field of Search ..... 418/97, 98, 201, DIG. 1, 418/99, 100, 102

[56] References Cited

U.S. PATENT DOCUMENTS

| | | | |
|---|---|---|---|
| 3,462,072 | 8/1969 | Schibbye | 418/98 |
| 3,820,923 | 6/1974 | Zweifel | 418/99 |
| 4,173,440 | 11/1979 | Libis | 418/98 |

*Primary Examiner*—John J. Vrablik

*Attorney, Agent, or Firm*—Sughrue, Mion, Zinn, Macpeak & Seas

[57] ABSTRACT

Intermeshed helical screw rotors are mounted for rotation by anti-friction bearings surrounding integral shafts extending axially outward of the ends of the intermeshed screw rotors and within respective high pressure outlet and low pressure inlet bearing housings, sealed to the exterior. Oil from a separator/sump at or near compressor discharge pressure feeds via a closed passage to annular cavities surrounding the rotor shafts upstream of the outlet housing bearings. Oil seeps through very narrow annular gaps functioning as self-cleaning upstream capillaries to the outlet bearing cavities with the pressure reduction causing oil mist lubrication of the confined bearings within the outlet bearing housing. Further passages fluid connect the outlet bearing housing cavities to similar cavities within the inlet bearing housing where mist lubrication of the inlet bearings occurs. Further, oil passage means connect the inlet bearing housing cavities to an oil injection port via a downstream capillary with the oil injection port opening to the working chamber first closed thread. The upstream and downstream capillaries insure proper pressure reduction through the single loop lubrication system and the downstream capillary functions to maintain a pressure differential between the inlet bearing housing and the suction side of the intermeshed screws when the slide valve shifts to full unloaded position such that the oil injection port is open directly to the suction port of the compressor.

5 Claims, 1 Drawing Figure

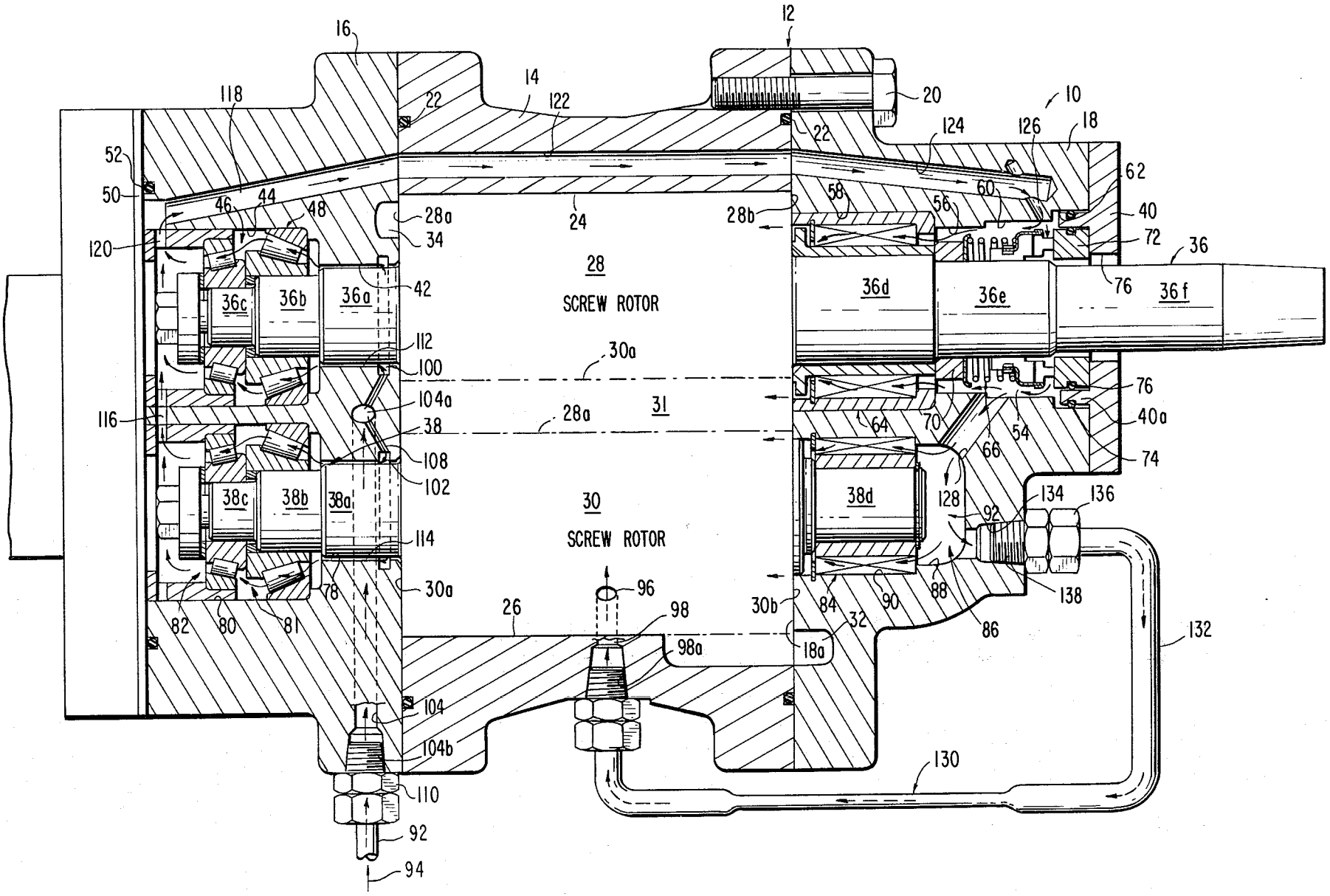
28
SCREW ROTOR
30
SCREW ROTOR
31
36f
36e
36d
38d
36a
36b
36c
38a
38b
38c

SELF-CLEANING SINGLE LOOP MIST TYPE LUBRICATION SYSTEM FOR SCREW COMPRESSORS

FIELD OF THE INVENTION

This invention relates to rotary helical screw compressors and more particularly to an improved lubrication system for such helical screw compressors.

DESCRIPTION OF THE PRIOR ART

Rotary helical screw compressors have evolved over the years into compact unitary compressors operating at high efficiency with limited frictional loss due to the incorporation of anti-friction bearings for mounting of the helical rotor shafts at respective high pressure and low pressure ends of the intermeshed helical screw rotors defined by the compressor discharge and suction pressures, respectively.

Further, over the years, such screw compressors have been incorporated in systems such that lubricating oil is transmitted with the compressor working fluid, whether it be air, refrigerant vapor or the like, and liquid injection ports have been employed for injecting liquid directly into a closed thread forming an element of the working chamber of the compressor. The injected liquid may be either a refrigerant bearing oil which flashes upon injection, or all oil after separation from the working fluid at a point within the system downstream from the compressor itself. It has been determined that lubrication of anti-friction bearings for such compressors may be advantageously effected if the lubricating oil is in mist form. Such teachings are incorporated to a certain extent in U.S. Pat. No. 4,181,474 issued Jan. 1, 1980 and assigned to the common assignee. The helical screw rotary compressor may be of the hermetic type where the electrical drive motor is incorporated within an outer casing with the screw compressor or of the open type. Drilled or otherwise formed passages may be utilized within the rotors and the compressor stator portions, that is, the compressor casing or housing to direct oil under high pressure to respective bearings at both the high side and low side of the machine. In the past, a number of passages form parallel paths to feed oil separated from the working fluid and near compressor discharge pressure to points where it performs a lubricating function. Lubricating oil then seeks the low pressure or low side of the machine under the pressure differential as seen between the compressor suction and discharge ports. Such lubricating systems have been complicated by the necessity of including multiple, parallel flow path passages within the rotor structure of fine diameter. Such passages leading to given bearings tend to clog. Further, the oil supply flows to a given bearings may be in excess of the needs of such bearings.

It is, therefore, a primary object of the present invention to provide a simplified and preferably single loop lubricating system for a helical screw compressor which minimizes the oil entrained in the working fluid, the oil necessary to lubrication, and which insures an all oil mist lubrication of the bearings regardless of load conditions under which the compressor operates.

It is a further object of the present invention to provide an improved simplified oil mist type lubrication system for a helical screw compressor which is self-cleaning at an upstream capillary which functions to provide the primary control pressure reduction to the single loop oil circuit.

It is a further object of the present invention to provide a single loop, self-cleaning, mist type lubricating system for a helical screw compressor wherein a single loop entry point accomplishes lubrication of the entire machine with the overflow inducted into the first closed thread to enhance rotor sealing without contributing to direct compression loss under compressor full load conditions.

SUMMARY OF THE INVENTION

The invention is directed to improvements within a helical screw compressor having a central housing including intersecting cylindrical bores closed off at opposite ends by an outlet end bearing housing and an inlet end bearing housing within which are mounted, by way of shafts protruding from a pair of intermeshed helical screw rotors, anti-friction bearings within sealed cavities at the outlet end and inlet end of the compressor, respectively. The compressor further includes a low pressure suction port adjacent the inlet end bearing housing and opening to the intermeshed screws at the low side of the compressor and a high pressure outlet or discharge port adjacent the outlet end bearing housing and at the high side of the compressor. The intermeshed helical screw rotors form with the casing bores a compressor working chamber defined by closed threads. The compressor receives a working fluid which bears oil for lubrication and an oil separator downstream of the compressor outlet separates oil from the working fluid at or near discharge pressure. An oil injection port opens through the casing directly into a closed thread of the working chamber to provide oil to the intermeshed screws for sealing and lubricating purposes.

The improvement resides in oil passage means within the compressor bearing oil under pressure, from the separator and in fluid communication with at least the inlet and anti-friction bearings, and from those anti-friction bearings to the injection port. An upstream capillary is provided within the oil passage means between the separator and said anti-friction bearings to effect pressure reduction and change of the oil to oil mist form for lubricating those anti-friction bearings. A downstream capillary is provided within the oil passage means intermediate of those anti-friction bearings and the oil injection port to insure a pressure differential across those anti-friction bearings towards the compressor suction port even where the oil injection port is open to the compressor suction port during compressor unloading.

The system is preferably employed in a helical screw compressor having a slide valve for selectively varying the return of uncompressed working fluid to the suction port so as to permit the compressor to be fully unloaded, and wherein the slide valve operates to insure direct communication between the injection port and the compressor suction port to guarantee sufficient lubrication of the compressor inlet end bearings when the compressor is unloaded due to the pressure differential existing across the downstream capillary means.

Preferably, the oil passage means forms a single loop, placing the outlet end and inlet end bearings in series, with the upstream capillary means upstream of the inlet end bearings and the second downstream capillary means downstream of the outlet end bearings within the oil passage means. The upstream capillary means may comprise very thin annular gaps between the rotor shafts and the outlet bearing housing upstream of the outlet end bearings; whereby, the annular gaps functions as self-cleaning capillaries to insure full oil mist lubrication of both the high side and low side bearings downstream of the upstream capillary means. The radial gaps between the rotor shafts and the outlet bearing housing may be equal to the diameter of a capillary tube section of the oil passage means leading from the inlet end bearing housing cavities housing the inlet end bearings to the oil injection port and forming said downstream capillary means.

BRIEF DESCRIPTION OF THE DRAWINGS

The single FIGURE is a cross-section of an open type helical screw rotary compressor incorporating the self-cleaning, single loop, mist type lubrication system forming one embodiment of the present invention.

DESCRIPTION OF THE PREFERRED EMBODIMENT

Referring to the drawing, there is shown one embodiment of the present invention in which the single FIGURE constitutes a cross-sectional view of an open-type helical screw compressor provided with a self-cleaning, mist type lubrication system for the bearings supporting the helical screw rotors of the compressor and constituting one embodiment of the present invention. The compressor, indicated generally at 10, is comprised of a generally cylindrical compressor housing, indicated generally at 12. It includes a central housing 14, an outlet end bearing housing 16, to the left, and an inlet end bearing housing 18, to the right. The end bearing housings are bolted to the central housing as by way of bolts 20, and the housings are sealed together at their abutting ends by way of O-ring seals 22, in conventional fashion.

The central housing 14 includes a pair of intersecting bores as at 24 and 26 within which reside intermeshed helical screw rotors 28 and 30, respectively. Rotors 28 and 30 are illustrated in dash-dot form at their intermeshed threads, as at 28*a* and 30*a*, respectively. This indicates an area of overlap or intermesh 31 between the teeth or threads of these rotating members. A first cavity comprising the compressor inlet or suction port 32 is formed partially within the central housing 14 and the inlet end bearing housing 18 and opens to the intermeshed helical screw rotors 28 and 30 to permit a gaseous working fluid such as a refrigerant to enter the compressor working chamber as defined by intermeshed threads of rotors 28 and 30. An outlet port 34 for the compressor is shown as located within the outlet end bearing housing 16 at the interface between that housing and the end of rotor 28 and is diametrically opposite from inlet port 32.

Conventionally, the portion of the compressor at the outlet end bearing housing 16 is defined as the high side or high pressure side of the machine and associated with the discharge or outlet port 34. The portion of the compressor adjacent the inlet or suction port 32 and to the right of the intermeshed rotors 28, 30 is known as the low side or low pressure side. The helical screw rotors 28 and 30 are provided with integral shafts generally at 36, 38, respectively. The rotor 28 may be of the female type and may function to directly drive the male rotor 30. In that respect, shaft 36 is longer than shaft 38, having one end which protrudes outwardly of the compressor housing 12. In fact, it extends axially beyond the inlet end bearing housing end wall 40 which is fixedly sealed to the outer end of the inlet bearing housing 18. The outlet end bearing housing 16 and the inlet end bearing housing 18, while being generally cylindrical, are machined to provide internally, two large bearing cavities within which shafts 36, 38 project, and to permit the rotors 28, 30 to be supported for rotation by appropriate bearing assemblies with said cavities. The outlet end bearing housing 16 is bored at 42 and further counterbored at 44. Shaft portion 36*a* is received within bore 42. An outlet end bearing cavity 46 is formed by counterbore 44, axially beyond shaft portion 36*a*. The shaft 36 includes further reduced diameter portions 36*b* and 36*c*, to the left of shaft portion 36*a* in the figure, to accommodate, in this instance, a back-to-back, double roller, anti-friction pack assembly indicated generally at 48.

The bearing assemblies employed in the compressor illustrated may be of the type shown in U.S. Pat. No. 4,181,474, referred to previously.

It should be noted that the outlet end bearing housing 16 bears a circular end plate 50 which is fixed to the end of the outlet end bearing housing and the cavity 46, housing bearing pack assembly 48, is sealed from the exterior by means of an O-ring seal as at 52 bearing on end plate 50. To the opposite side of rotor 28, shaft 36 includes, on that side, a portion 36*d* of given diameter which projects into one inlet end housing bearing cavity 54 defined by bore 56 within inlet end bearing housing 18 and a series of counterbores as at 58, 60 and 62. Counterbore 58 is to one side of bore 56, while counterbores 60 and 62 are to the other side, remote from rotor 28.

An anti-friction bearing assembly, indicated generally ay 64, is closely received within counterbore 58 and is interposed between the inlet bearing housing 18, in that area, and portion 36*d* of shaft 36. The remaining portion of the cavity 54 is taken up by a shaft rotor seal mechanism, indicated generally at 66. It includes a coil spring 68 and axially opposed annular seal members 70 and 72 which are spring biased in opposite directions to perform the desired sealing. End plate 40 of annular form closes off the outboard end of the inlet end bearing housing 18 counterbore 62. End plate 40 includes an integral collar 40*a* which projects inwardly within cavity 54 and which bears an O-ring as at 74, bearing on counterbore 62 to provide a seal between these two relatively fixed members. The annular seal member 72 also carries an O-ring as at 76 functioning as a radial seal. The annular seal member 70 is sized to the diameter of a shaft section 36*e* about which it is concentrically mounted with one end abutting the end of bearing pack assembly 64 against which it is biased by means of coil spring 68. The shaft further terminates in a reduced diameter portion 36*f* which projects outwardly of the end plate 40 through a circular hole 76 within that member.

An electric motor or the like (not shown) may be mechanically connected to shaft portion 36*f* for positive drive of the compressor rotor 28, which, in turn, self-drives the intermeshed rotor 30 by way of intermeshed threads (not shown), within the area between dash dot lines 28*a*, 30*a*.

Rotor 30 is similarly mounted for rotation about its axis and by way of shaft 38, integral with that rotor. In that respect, the outlet end bearing housing 16 is further bored at 78 and counterbored at 80 parallel to bore 42 and counterbore 44, so as to form a second bearing cavity indicated generally at 91. Shaft portion 38*a* projects within bore 78 and is generally of the same length. The shaft 38 is further provided with reduced diameter portions 38*b* and 38*c* to the left of portion 38*a*, in that order, and of decreasing diameter. The cavity 81 functions as one outlet bearing cavity and carries an anti-friction bearing pack assembly indicated generally at 82 and comprised of back-to-back roller type anti-friction bearings which may also be of the type illustrated in U.S. Pat. No. 4,181,474. Bearing pack assembly 82, as does bearing pack assembly 48, provides for absorption or take up of generated thrust as well as radial forces acting through the shaft on the stationary housing. End plate 50 closes off cavity 81 to the left. Again to the right side of rotor 30, inlet end bearing housing is formed with a second bore 88 and counterbore 90 parallel with bore 56 and a series of counterbores. Anti-friction bearing assembly 84 is fitted within counterbore 90 and about a shaft portion 38*d*. The bore 88 and counterbore 90 form a second inlet end bearing housing bearing cavity 92 extending beyond shaft portion 38*d* and is advantageously employed in the lubrication system of the present invention.

In general, the compressor 10 described to this point is conventional, and is fully supported by teachings within the patent referred to. It permits application of the present invention to such compressor. Further, conventionally, compressors of this type have been employed in the refrigeration and air conditioning industry with the working fluid comprised of a refrigerant such as R12. A working fluid in gaseous form is returned from such refrigeration system coils to the suction port such as suction port 32 of compressor 10, with the working fluid in vapor or gaseous form what it is compressed from a relatively low pressure to a high pressure prior to discharge as a vapor or gas at the high side of the compressor or machine, via discharge port 34.

Further, conventionally, such compressors have been lubricated by oil carried by the working fluid, and transported due to pressure differential through the closed loop refrigeration system or between portions thereof. Both in the refrigeration and air conditioning areas, and more importantly within air compressor systems utilizing helical screw rotary compressors, it is important that downstream of the compressor itself the working fluid be essentially devoid of oil, although the same may be oil laden in the area of compression. As such, it is conventional to employ within the system an oil separator (not shown) downstream from the compressor which is connected to the discharge port of the compressor, and where the oil is separated from the working fluid. Normally, oil is retained within an oil sump from which it is fed, due to the pressure differential between the compressor high and low sides, back to the compressor as a liquid flow stream and directed by suitable passages within the compressor housing and/or rotors to cavities housing the bearings for lubrication of the bearings supporting the rotors for rotation.

Such is true of the instant invention. In this case, the oil separator/sump is purposely not shown for simplicity purposes. However, the drawings do show a tubular oil supply line 92 as leading from the oil separator (not shown) for supplying oil at or near compressor discharge pressure as indicated by arrow 94. The oil supply line 92 functions as one element of a single loop lubrication system for the compressor 10 and partially defines the oil passage means of the compressor. Oil line 92 is, in itself, conventional.

Further, as indicated previously, it is conventional to employ an injection port such as port 96 which opens to the compressor working chamber, as for instance into bore 26 of central housing 14 and being formed by a radially drilled hole 98 having an enlarged threaded entry portion 98*a*. It is at this point that the compressor 10 and the components carried thereby vary from the prior art and where the features hereinafter described are directed to the single loop, self-cleaning mist type lubrication system of the present invention for such helical screw rotary compressors.

In that respect, at the high side of the machine 10, and specifically within the outlet end bearing housing bores 42 and 78, there are provided a pair of annular cavities or grooves 100 and 102 opening up to the respective bores 42 and 78 and formed very near the outlet end faces 28*a* and 30*a* of respective intermeshed helical screw rotors 28 and 30. Further, a passage 104 is formed within the outlet end bearing housing 16 leading from the outside or periphery of the outlet end bearing housing 16 and terminating as at 104*a*, intermediate of bores 42 and 78. Small diameter branch passages 106 and 108 open at one end to passage 104 and at their other ends to respective annular grooves 100 and 102. The oil line 92 terminates in a threaded fitting 110 which is threaded to an enlarged threaded portion 104*b* of passage 104 to sealably connect the oil line 92 to passage 104 permitting oil under pressure to be fed to the annular grooves 100 and 102.

As an important aspect of the invention, shaft portion 36*a* is of predetermined diameter and only slightly smaller than the diameter of bore 42 which receives the same to form a very thin annular gap 112 which is of a predetermined fine radial clearance. For instance, in the illustrated embodiment, the compressor may be, an 82 MM compressor, in which case the radial clearance or gap 112 between shaft portion 36*a* and bore 42 of the outlet bearing housing 16 may be on the order of 0.006 to 0.007 inches. This annular gap opens to the left directly to bearing cavity 46 housing the anti-friction bearing pack assembly 48. The oil in escaping from annulus 100 to cavity 46, must pass through this very restricted radially narrow annular gap. Further, since the shaft 36 rotates within the outlet bearing housing 16, the radial clearance or gap 112 forms a basic self-cleaning capillary and is one upstream capillary forming the upstream capillary means of the improved mist type lubricating system of the present invention. Further, a similar, second self-cleaning upstream capillary or gap 114 is defined by shaft portion 38*a* and bore 78 within the outlet end bearing housing 16 for helical screw rotor 30, as at 114 with similar or equal radial clearance to capillary 112. Upstream capillary 114 opens to bearing cavity 81 housing bearing pack assembly 82. Bearing cavities 46 and 81 within the outlet end bearing housing 16 are in fluid communication with each other through passage 116.

It is important to note that the oil lubricates the bearing pack assemblies 48 and 82 in mist form, since the upstream capillaries 112, 114 accomplish the desired controlled pressure reduction between the oil within line 92 and that of cavities 46 and 80 and in view of the volume of those cavities. Further, as result of pressure reduction, any refrigerant entrained within the oil of line 92 vaporizes at this point in the single loop to facilitate oil mist formation and lubrication of the anti-friction bearings within the bearing cavities of outlet end bearing housing 16, if a refrigerant forms the compressor working fluid.

While the oil mist migrates from cavity 81 to cavity 46 via passage 116, the oil mist from both cavities tends to escape from the outlet end bearing housing 16 purposely through further passages within outlet end bearing housing 16, central housing 14, and inlet end bearing housing 18; thus from the high side of the machine toward the low side. Such passages form elements of the single loop lubrication system. In that respect, the outlet end bearing housing 16 includes an inclined passage as at 118 opening at one end to a radial passage 120 communicating to cavity 46, while its opposite end is in alignment with a longitudinal passage 122 within the central housing 14 which extends parallel to the axis of shaft 30 and bore 24 receiving rotor 20. Passage 122 extends the full length of central housing 14 and opens at its other end directly to an inclined passage 124 drilled within the inlet end bearing housing 18 from the end abutting the central housing 14 toward its opposite end, but terminating short thereof. A small diameter passage 126 connects that end of passage 124 of inlet end bearing housing 18 to bearing cavity 54 carrying the inlet end bearing pack assembly 64 and shaft rotor seal 66. Further, an inclined passage 128 fluid connects cavity 54 carrying inlet end bearing pack assembly 64 to bearing cavity 92 carrying bearing pack assembly 84 for shaft 38.

Oil entering the inlet end bearing housing 18 is sprayed directly onto the shaft rotary seal face of seal 66. The entire zone, that is, cavity 54, as well as cavity 86, is under a pressure that is basically determined by a downstream capillary indicated generally at 130 forming part of a tubular metal oil injection line 132. Oil injection line 132 communicates cavity 86 via passage 134 and fitting 136 to the threaded portion **98*a* of passage 98 via fitting 138. Downstream capillary 130 comprises a reduced diameter portion or capillary tube portion of oil line 132. The pressure in the inlet end bearing area, that is, within bearing cavities 54 and 86, exceeds the suction pressure at suction port 32 at the inlet ends 28*b* and 30*b* of rotors 28 and 30. They are exposed to a pressure difference driving the oil through the inlet end bearing pack assemblies 64 and 84. This is approximately the difference between the first closed lobe pressure at port 96 and suction pressure at the compressor inlet or suction port 32. However, the downstream capillary 130 further enhances the pressure differential by the amount necessary to guarantee sufficient lubrication of the inlet end bearings when the compressor is unloaded, that is, when a slide valve (not shown) shifts to insure that the injection port 96 is open directly to the compressor inlet or suction port 32, at which point absent the downstream capillary 130**, there would be no net pressure differential extending across the inlet end bearings.

As may be appreciated, the single loop entry point defined by passage 104 accomplishes lubrication of the entire machine with the overflow exiting through passage 134 from bearing cavity 86 and being inducted into the first closed lobe or thread area. Single loop flow is indicated by the arrows within passage 104, branch passages 106 and 108, cavities 46 and 80, and passages 116, 120, 118, 122 and 124, cavity 54, passage 128, chamber 86, oil injection line 132 and oil injection passage 98 and leading to injection port 96. The arrows also indicate the escape or passage of lubricant through the bearing pack assemblies with oil mist seeking the suction or low side of the machine at the interface between the suction or inlet ends **28*b*, 30*b* of rotors 28, 30 and face 18*a* of the inlet end bearing housing 18**.

Contrary to systems utilizing many separate feed points in an oil lubrication system, under the present system, there are no small orifices to plug, as all the close clearance restriction zones have one surface rotating relative to the other. As such, the upstream capillaries are novely self-cleaning.

As may be appreciated, it is necessary to properly select the upstream capillary annulus or gap area and the downstream capillary area. It is possible that in order to maximize part load performance without undue pressure at the inlet end of the machine, the upstream capillaries as at 112, 114 may have to be reduced in area. The system functions to minimize the oil needed for lubrication and thus the refrigerant entrained in the oil, insures an all oil mist lubrication for the bearings supporting the rotors and prevents oil in liquid form from reaching the bearing areas irrespective of the range of conditions under which the machine is operating, that is, between fully loaded and fully unloaded conditions.

While the invention has been particularly shown and described with reference to a preferred embodiment thereof, it will be understood by those skilled in the art that various changes in form and details may be made therein without departing from the spirit and scope of the invention.

What is claimed is:

1. In a helical screw rotary compressor comprising a sealed compressor housing including a central housing defining intersecting parallel cylindrical bores and inlet and outlet end bearing housings, intermeshed helical screw rotors mounted within respective bores for rotation about their axes, shafts borne by said rotors, sealed bearing cavities within said compressor housing inlet and outlet end bearings housings and about said shafts at opposite ends of said rotors, anti-friction bearings mounted within said cavities and supporting said shafts for rotation therein, said intermeshed helical screw rotors and said cylindrical bores defining a compressor working chamber defined by closed threads of the intermeshed helical screw rotors, a low pressure suction port opening to one side of the intermeshed helical screw rotors, and a high pressure discharge port open to said intermeshed helical scew rotors to the opposite sides thereof, an injection passage borne by said housing forming an injection port opening directly into the first closed thread from said suction port for permitting fluid injection to the intermeshed helical screw rotors for sealing and lubricating purposes, the improvement comprising:

oil passage means within said compressor forming a single lubrication loop leading from said compressor working chamber initially to the sealed bearing cavities within the outlet end bearing housing, from said sealed bearing cavities within said outlet end bearing housing to the sealed bearing cavities within the inlet end bearing housing and from said sealed bearing cavities within the inlet end bearing housing to said injection port open to said compressor working chamber, and wherein said single lubrication loop includes upstream capillary means within said oil passage means upstream of said sealed bearing cavities within said inlet end bearing housing to effect a partial pressure reduction within said oil passage means upstream of said inlet end sealed bearing cavities to change lubricating oil to oil mist form for effective lubrication of the anti-friction bearings formed by said sealed bearing cavities, and downstream capillary means within said single lubrication loop between said sealed bearing cavities of said inlet end bearing housing and said injection port to insure a further pressure reduction across said anti-friction bearings towards the compressor suction port, even under conditions where the oil injection port is directly open to the suction port during compressor unloading, thereby minimizing the oil entrained in the working fluid insuring an all oil mist lubrication of the bearings, regardless of load conditions and in which the oil mist type lubrication system is self-cleaning at the upstream capillary means.

2. The helical screw rotary compressor as claimed in claim 1, wherein said oil passage means fluid connecting the sealed bearing cavities within said inlet end housing to said injection port comprises a tube, and wherein said downstream capillary means comprises a reduced diameter portion of said tube forming a small diameter capillary passage intermediate of said inlet end housing sealed bearing cavities and said injection port.

3. The helical screw rotary compressor as claimed in claim 1, wherein said shaft means for said helical screw rotors within said outlet end bearing housing project through bores within said outlet end bearing housing axially inwardly of the anti-friction bearings supporting said rotor shafts within said outlet end bearing housing and form thin, annular gaps as self-cleaning capillaries and comprising said upstream capillary means.

4. The helical screw rotary compressor as claimed in claim 3, wherein said bores within said outlet end bearing housing receiving said shafts, upstream of said anti-friction bearings within said outlet end bearing housing cavities, each further comprise an annular groove, and wherein said oil passage means comprises a single oil passage extending generally radially inwardly from the periphery of said outlet end bearing housing and terminating at a point intermediate of said bores within the outlet end bearing housing and branch passages opening at one end to said single passage and at their opposite ends to respective annular grooves such that said grooves function as an oil supply manifold to said annular gaps defining said self-cleaning capillaries upstream of said anti-friction bearings within said outlet end bearing housing.

5. The helical screw rotary compressor as claimed in claim 3, wherein said oil passage means fluid connecting the sealed bearing cavities within said inlet end housing to said injection port comprises a tube, and wherein said downstream capillary means comprises a reduced diameter portion of said tube forming a small diameter capillary passage intermediate of said inlet end housing sealed bearing cavities and said injection port.

* * * * *

UNITED STATES PATENT AND TRADEMARK OFFICE

CERTIFICATE OF CORRECTION

PATENT NO. : 4,439,121

DATED : March 27, 1984

INVENTOR(S) : David N. Shaw

It is certified that error appears in the above-identified patent and that said Letters Patent is hereby corrected as shown below:

Column 2, line 64, change [inlet] to --- outlet ---

Column 2, line 66, change [outlet] to --- inlet ---

Column 8, cliam 1, line 67, change [inlet] to --- outlet ---

Signed and Sealed this

*Seventeenth* Day of *June 1986*

[SEAL]

*Attest:*

DONALD J. QUIGG

*Attesting Officer*

*Commissioner of Patents and Trademarks*